US007144223B2

(12) United States Patent
Buzzi

(10) Patent No.: US 7,144,223 B2
(45) Date of Patent: Dec. 5, 2006

(54) SUPERCAVITATING PROPELLER WITH ADJUSTABLE CUP, AND THE METHOD TO ADJUST SAID CUP

(75) Inventor: Fabio Buzzi, Oggiono (IT)

(73) Assignee: ZF Trimax S.r.l. (IT)

( * ) Notice: Subject to any disclaimer, the term of this patent is extended or adjusted under 35 U.S.C. 154(b) by 18 days.

(21) Appl. No.: 10/899,853

(22) Filed: Jul. 27, 2004

(65) Prior Publication Data

US 2005/0025626 A1 Feb. 3, 2005

(30) Foreign Application Priority Data

Jul. 28, 2003 (IT) ..... MI2003A1541

(51) Int. Cl.
*B63H 5/07* (2006.01)

(52) U.S. Cl. ..... 416/247 A; 416/236 R; 416/242; 29/888.6; 440/49

(58) Field of Classification Search ..... 416/203, 416/244 B, 247, 237, 236 R, 235, 204 R, 416/242; 29/889.1, 889.6; 440/49, 381; 516/203, 204 R, 236 R, 237, 235, 242, 244 B, 516/247 A See application file for complete search history.

(56) References Cited

U.S. PATENT DOCUMENTS

| | | | | |
|---|---|---|---|---|
| 3,938,463 | A | 2/1976 | Hecker et al. | |
| 4,009,874 | A * | 3/1977 | Hughey | 269/3 |
| 4,188,906 | A | 2/1980 | Tachmindji et al. | |
| 4,293,280 | A | 10/1981 | Yim | |
| 4,605,376 | A | 8/1986 | Aschauer | |
| 4,696,651 | A | 9/1987 | Wagemann | |
| 4,789,306 | A * | 12/1988 | Vorus et al. | 416/223 R |
| 4,862,820 | A | 9/1989 | Guezou et al. | |
| 4,865,520 | A * | 9/1989 | Hetzel et al. | 416/236 R |
| 5,009,621 | A | 4/1991 | Bankstahl et al. | |
| 5,791,874 | A * | 8/1998 | Lang | 416/62 |
| 6,167,829 | B1 | 1/2001 | Lang | |
| 6,390,776 | B1 * | 5/2002 | Gruenwald | 416/203 |
| 6,439,148 | B1 | 8/2002 | Lang | |
| 6,467,422 | B1 * | 10/2002 | Elms | 416/237 |

* cited by examiner

*Primary Examiner*—Igor Kershteyn
(74) *Attorney, Agent, or Firm*—Stetina Brunda Garred & Brucker

(57) ABSTRACT

The invention describes a supercavitating propeller with adjustable cup, and a method to adjust the cup. The trailing edge of the propeller blade is characterised by a protuberance with a limited section compared to the blade's section at the conventional trailing edge. The protuberance height can be adjusted, hereby reducing the propeller blade's cup.

7 Claims, 3 Drawing Sheets

SUPERCAVITATING PROPELLER WITH ADJUSTABLE CUP, AND THE METHOD TO ADJUST SAID CUP

CROSS-REFERENCE TO RELATED APPLICATIONS

Not Applicable

STATEMENT RE: FEDERALLY SPONSORED RESEARCH/DEVELOPMENT

Not Applicable

FIELD OF THE INVENTION

The present invention relates to a supercavitating propeller with adjustable cup, and a method to adjust the cup.

BACKGROUND OF THE INVENTION

It is known that with fast planning hulls using surface drive propulsion it is always difficult to perfectly design the propellers that make the boat reach the theoretical project speed and the optimum engine revolutions, i.e. optimising engine loads, fuel consumption and life of all propulsion components.

This is mainly due to the fact that motorboats have an innate high variance of project factors that may influence the propeller design, such as overall weight, position of the centre of gravity, hull's roughness, drag resistance of appendices in water and in air and many others. Propellers are designed and produced, then tested on the vessel, which in most cases does not reach the desired speed or theoretical engine revolution. In this case propeller modifications are necessary, which requires that the propellers are removed from the boat and taken to a propeller workshop, where specialised technicians can modify them by means of dedicated machinery and tools. After the operation is concluded, the propellers will have to be reinstalled onto the vessel—which in the meantime must have waited for them on dry with usually high expenses for the boat owner—and be tested again. Even in the best case, in which the propeller gives optimal results after the first modification, this whole operation will have high costs and it will take days of work.

DETAILED DESCRIPTION OF THE INVENTION

Figure 1:
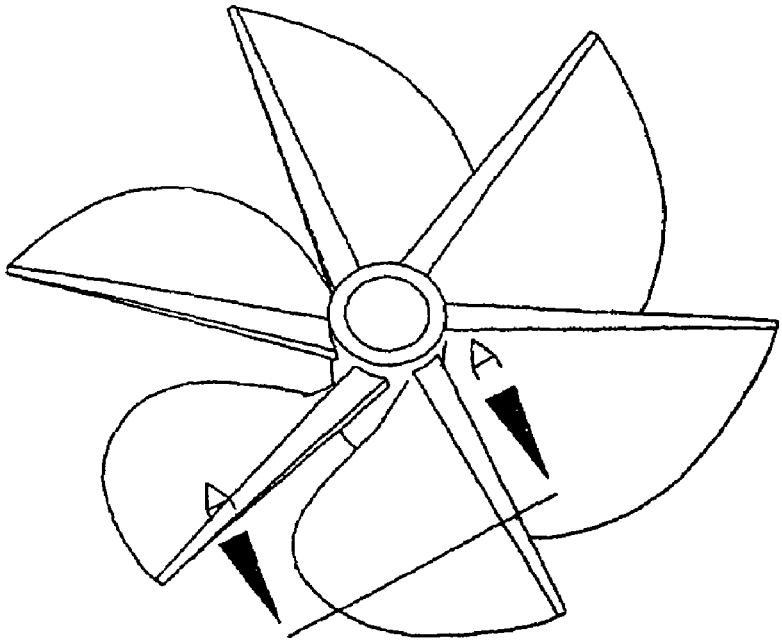
Fig. 1 (PRIOR ART)
FIG. 1 shows a conventional supercavitating propeller.
Figure 2:
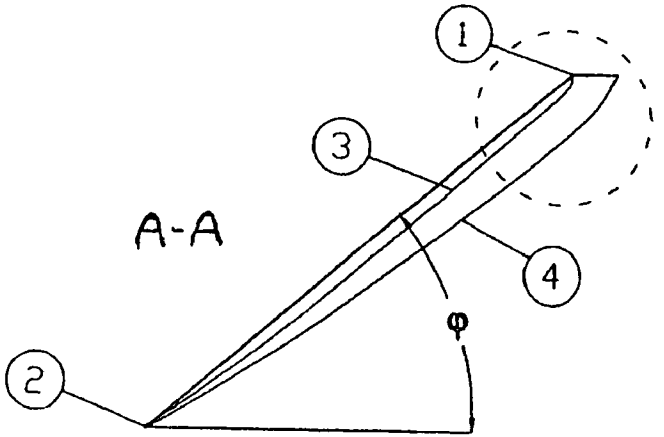
Fig. 2 (PRIOR ART)
FIG. 2 shows a cross-section of a blade of the conventional supercavitating propeller as indicated in FIG. 1.

A known propeller is described in FIG. 1, and FIG. 2 represents a section A—A of the propeller blade in FIG. 1. The section A—A is characterised by a sharp leading edge 2, where the water gets into contact with the blade first, and a trailing edge 1, where the water separates from the propeller. The side 3 onto which the water is accelerated is named pressure side; the opposite blade portion 4 is called suction side. The blade is characterised by the nominal pitch P, being it directly proportional to the blade inclination angle $\phi$ ( FIG. 2), that gives the advancement of the water particles accelerated by the blades in direction of the propeller's axis. The nominal pitch of the blade is calculated considering the straight line connecting leading 2 and trailing edge 1 (thick line in FIG. 2).

Figure 2A:
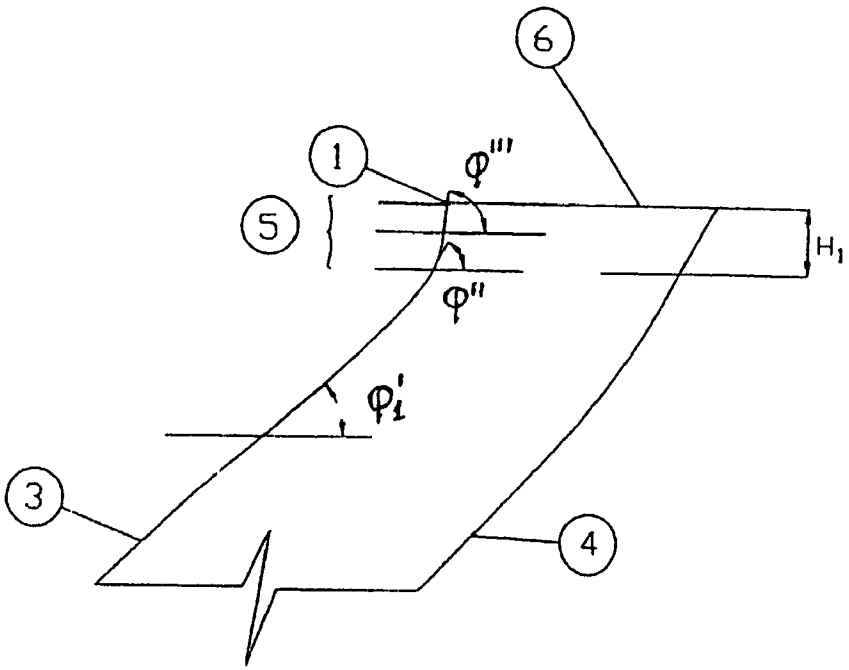
Fig. 2A: (PRIOR ART)
FIG. 2A shows an enlargement of the propeller's cup area dash circled in FIG. 2.

The blade inclination angle $\phi$ is considered between this line and the horizontal. On a complete 360°=2π angle propeller revolution around it's axis, the water particles in contact with the blades at a radial distance R1 from the propeller's axis, will advance by $$P=2\pi R_1\times\tan(\phi_1).$$

Where $\phi_1$ is the blade inclination angle measured at distance R1 from the axis. The punctual pitch P' in each point on the blade's pressure side is given by $$P'=2\pi R_1\times\tan(\phi_1')$$

where $\phi_1'$ is the inclination angle measured in this particular point (FIG. 2A).

Usually, the pressure side of the blade is arched (concave); in particular, the area close to the trailing edge 1 is characterised by a sudden increase in the local pitch, that keeps increasing up to the trailing edge where it can be very high, tending to infinite (FIG. 2A, angles $\phi_1''$ and $\phi_1'''$). With reference to the FIG. 2A, this blade portion 5 characterised by rapidly increasing pitch values compared to the average blade pitch is called "cup", and it imposes a higher direction variation to the water flow compared to that imposed by the portion of the blade closer to the leading edge. With 6 we indicate the trailing edge's plane.

This "cup" is extremely important especially in the planning phase of the vessel, characterised by a natural cavitating effect from the propeller. Provided that the propeller is correctly designed (in regards to diameter, pitch and blade number), in the acceleration phase, in which the vessel's speed is still far away from the maximum theoretically reachable speed, the propeller works in cavitation, since it is not working in water only, but in a water-air mix, which increases the propeller slip.

A correct propeller design, which keeps the cavitating effect under certain values, will make the engine reach about 90% of its nominal revolution value, where the engine develops is high power values therefore guaranteeing good acceleration.

The control on the propeller's cavitation is mainly given by the propeller cup; a correct cup will keep the cavitation within certain limits during the delicate planning phase, guaranteeing a good propeller thrust. A low cup will not control the cavitation that will reach too high levels, reaching the so called "hypercavitation" (engine over 100% of its nominal revolution) in which the propeller flutters, without transferring the engine power to the water. As a consequence, this propeller will give a very limited thrust, causing the planning phase to be extremely slow and eventually not to reach the planning condition at all.

On the other hand, the higher the cup, the more direction variation is imposed to the water flow, the higher the angular momentum imposed—and so the energy absorbed by the propeller—will be; the propeller's rotational resistance increases and more engine power is necessary, the engine will not be able to reach optimal revolution since the engine's power curve will cross the propeller's resistance curve at lower speed values.

Finally, a high cup improves the planning phase, but negatively affects revolution speed and maximum speed; on the other hand, a low cup allows a higher revolution speed and thus a higher speed, but determines a longer planning phase.

Goal of the present invention is to overcome the aforementioned problems and to indicate a supercavitating propeller which allows to adjust the cup, in order to optimise both the planning phase and the engine revolutions (i.e. the top speed) when the boat is on plane.

The propeller according to the invention has a special trailing edge one each blade, characterised by a particular protuberance compared to a conventional propeller blade.

Said protuberance is positioned on the horizontal plane top of the trailing plane, preferably along the full blade, from the hub to the blade's external tip, having a limited section compared to the blade's section at the conventional trailing edge. This protuberance increases the propeller's cup.

Another aspect of the invention regards the procedure to modify the cup, by adjusting the protuberance's height, which can be reduced per abrasion with the help of a grinder, reducing hereby the overall blade's cup. All this with a simple and easy operation, which can be done by non experts and in case without removing the propeller from the propeller shaft. This is in favour of the costs and time necessary to optimise the propeller.

To achieve the above mentioned targets a supercavitating propeller in accordance with the invention is characterised by a having a quickly adjustable cup and a method for the cup adjustment, which are more precisely described in the claims, which are integral with this description.

The characteristics of the invention will be exposed with reference to the following example, described through the enclosed drawings, which represent a non limiting example, a preferred geometry of said invention.

In the annexed drawings, corresponding elements are always identified by the same reference numbers.

Figure 3A:
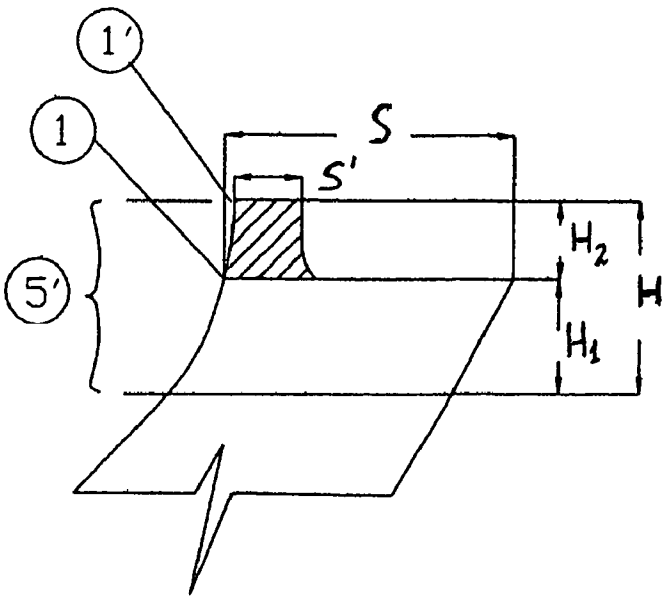
FIG. 3A shows an enlargement of the propeller's cup area dash circled in FIG. 3.
Figure 3:
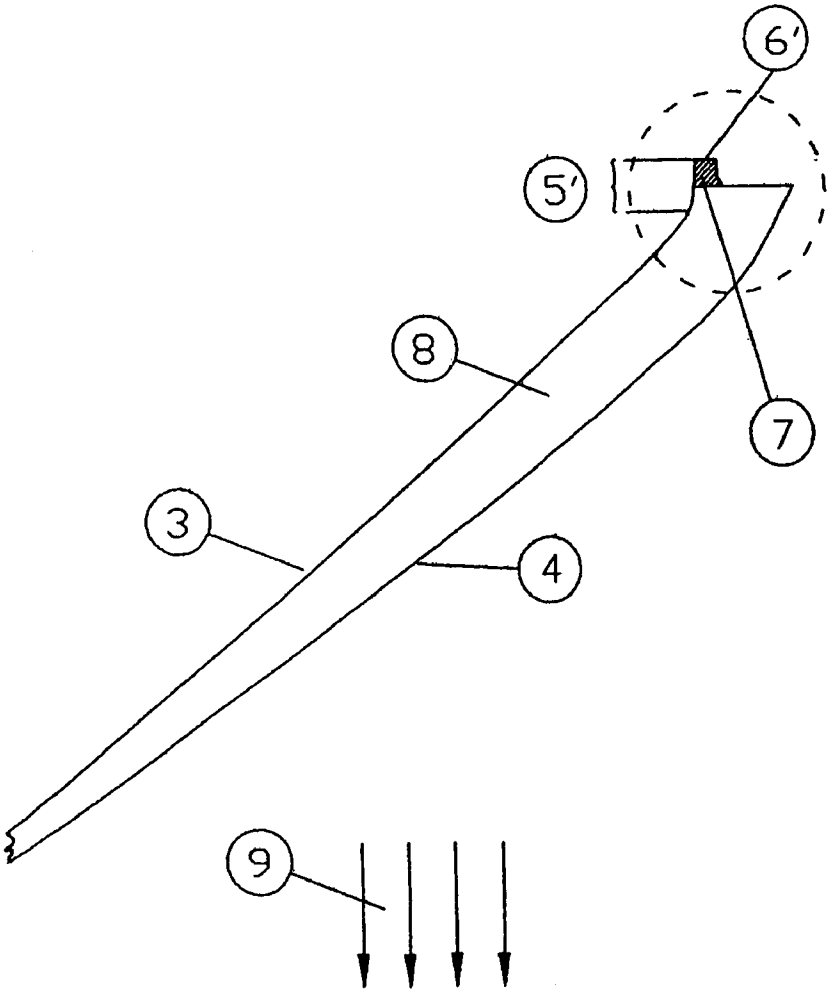
FIG. 3 shows a cross-section of the supercavitating propeller blade in accordance with the invention.

With reference to FIG. 3 and 3A, the propeller according to the invention is characterised by specially designed blades. Each blade comprises a protuberance 7, henceforth named "supercup", on the plane of the trailing edge 1, having height H2 and thickness S'. This protuberance originates a new trailing edge, 1' to be higher than the conventional trailing edge 1. The result of this is that the cup area on conventional blade design of height H1 is now extended by H2 to an overall height of H=H1+H2 to finally obtain an overall cup portion 5' as an extension of the blade's pressure side 3. This, for each propeller blade. In addition to this, the new trailing plane 6' with thickness S' is by far thinner than the conventional trailing plane 6 with thickness S.

The cup imposes a much more drastic direction change to the water flow in the opposite direction to the boat's forward moving direction 9, compared to the blade portions closer to the leading edge 2. With the added protuberance 7 (FIG. 3), which increases the cup area height from H1 to H, this "gradient" will be even more stressed. The height H=H1+H2 is supposed to be more than the height theoretically requested, in order to ensure a correct planning phase without hypercavitating effect; on the other hand, we will expect that the engines won't eventually reach 100% of the nominal revolutions (and so the theoretical maximum achievable speed). To reach 100% revolutions the propeller will have to be machined.

Reducing the cup area will reduce the resistance offered by the propeller, reducing hereby the momentum given to the water flow. This simple operation guarantees an engine revolutions gain when the boat is on plane, proportional to the height reduction of the cup area 5' itself.

Ultimately, the propeller's cup must be adjusted in function of the vessel's characteristics, in order to reach optimal engine revolutions at high speeds but without hypercavitating effects during the planning phase.

In accordance with another embodiment of the invention, a method for adjusting the cup is described, comprising adjusting the height H2 of the protuberance 7.

Initially the protuberance 7 is realised, in accordance with the description above, keeping the height H2 slightly higher than the theoretical design requirements. Then the height H2 is reduced during the tuning phase.

The reduction can be done easily and quickly, with a common tool like a rotative grinder, reducing herewith the overall cup height. All this with a simple and easy operation, which can be done by non experts, in case without removing the propeller from the boat. This is in favour of costs and time necessary to optimise the propeller.

Hereby we obtain the evident advantage as the grinding operation is easier to be performed, since the thickness S' of the supercup protuberance 7 is by far lower than the thickness S of the plane of the trailing edge 6 of on a conventional blade.

The "supercup" protuberance can easily be partially or completely reduced in height in a few minutes time and without the need of any dedicated tool or specialised operators, in case, without removing the propeller from the propeller shaft.

The reduction of the cup portion must be performed step by step, with a minimal increase, in order not to remove too much cup, that will irrevocably turn a propeller that gives good thrust during the planning phase in a hypercavitating, useless one.

The protuberance should normally be grinded on the trailing edge along the whole trailing edge, from the hub to the blade's tip; considering that the external part of the blade is the most effective for the propulsion, an expert hand could also grind the external portion of the blade only, giving herewith a cup area height, that will change with the radius, further reducing the necessary time for this operation.

Figure 4:
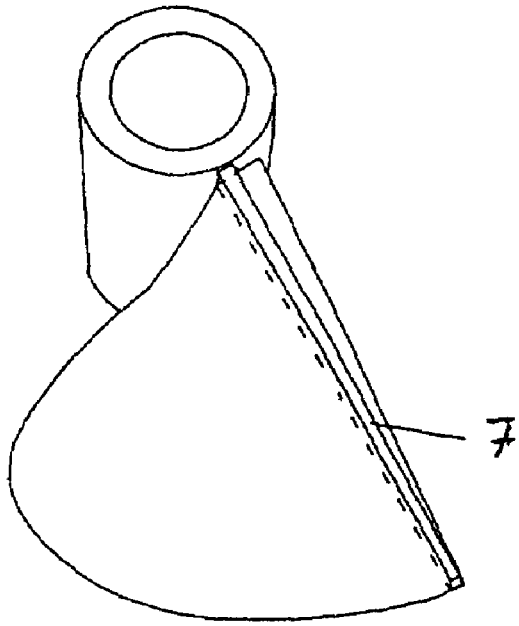
FIG. 4 shows one full blade of a supercavitating propeller according to the invention.

FIG. 4 shows a propeller blade according to this invention, to be confronted with a conventional blade as shown in FIG. 1.

The protuberance 7 runs along the horizontal trailing edge plane, preferably from the hub to the blade's tip, and its thickness is lower than the thickness of the blade in correspondence with the conventional trailing edge.

There are many variations allowed to the non limiting example here described, without leaving the coverage field of the present invention, which include all the equivalent implementations that skilled people in the art may perform.

As an example, the protuberance 7 may extend only on part of the trailing edge, for example close to the external tip of the blade.

From the description above a skilled man might realise the object without introducing new constructive details.

What is claimed is:

1. A marine bladed propeller comprising:

a plurality of blades, each blade having a positive pressure side and a trailing edge at the separation of the water from the propeller in forward motion at the positive pressure side, the trailing edge including a cup portion and a protuberance, the protuberance having a smaller thickness than a thickness of the blade;

wherein the protuberance has a height which extends a height of the cup portion to a total height at the positive pressure side.

2. The marine bladed propeller in accordance with claim 1, wherein said protuberance extends along the whole length of the trailing edge.

3. The marine bladed propeller in accordance with claim 1 wherein said protuberance extends along a portion of the whole length of the trailing edge.

4. A process to adjust the cup of a propeller comprising the steps of:

forming a protuberance with a height in excess of a desired cup height; and reducing said height step by step untill a predetermined cup height is obtained.

5. The process of claim 4 wherein the reducing the height of the protuberance is obtained by a machining step.

6. The process of claim 5 wherein the machining step reduces the height of the protuberance along the entire length of the protuberance.

7. The process of claim 5 wherein the machining step includes the step of machining the protuberance along the blade tip in a variable manner with respect to the trailing edge of the relevant blade.

* * * * *